US006363868B1

(12) United States Patent
Boswell et al.

(10) Patent No.: US 6,363,868 B1
(45) Date of Patent: Apr. 2, 2002

(54) COMBUSTORS AND BURNERS WITH HIGH TURNDOWN RATIO

(75) Inventors: John J. Boswell, Palm Beach Gardens, FL (US); Dale R. Eichmeyer, Lebanon, MO (US)

(73) Assignee: Independant Stave Co., Lebannon, MO (US)

( * ) Notice: Subject to any disclaimer, the term of this patent is extended or adjusted under 35 U.S.C. 154(b) by 0 days.

(21) Appl. No.: 09/639,834

(22) Filed: Aug. 16, 2000

Related U.S. Application Data

(60) Provisional application No. 60/151,840, filed on Sep. 1, 1999, and provisional application No. 60/149,273, filed on Aug. 17, 1999.

(51) Int. Cl.[7] ..... F23J 15/00; F23B 5/00; F23G 7/06

(52) U.S. Cl. ..... 110/213; 110/235; 110/251; 110/203; 110/182.5; 110/302; 110/210; 110/211; 110/212

(58) Field of Search ..... 110/235, 251, 110/252, 260, 261, 262, 263, 264, 265, 266, 203, 204, 205, 208, 182.5, 344, 347, 348, 301, 302, 303, 345, 295, 297, 210, 211, 212, 213; 126/224; 431/115, 116, 162, 165, 166, 173

(56) References Cited

U.S. PATENT DOCUMENTS

| | | | | | |
|---|---|---|---|---|---|
| 548,254 | A | * | 10/1895 | Horsfall | 110/182.5 |
| 1,943,132 | A | * | 1/1934 | Maul | 110/182.5 |
| 1,952,227 | A | * | 3/1934 | Adams | 110/7 |
| 3,203,377 | A | * | 8/1965 | Claassen et al. | 110/18 |
| 3,893,810 | A | | 7/1975 | Lientz | |
| 4,289,481 | A | * | 9/1981 | Yano | 432/96 |
| 4,334,484 | A | | 6/1982 | Payne et al. | |
| 4,565,137 | A | | 1/1986 | Wright | |
| 4,687,436 | A | | 8/1987 | Shigeta | |
| 4,920,925 | A | * | 5/1990 | Korenberg et al. | 122/149 |
| 4,958,619 | A | * | 9/1990 | Kardas | 126/85 R |
| 4,989,549 | A | * | 2/1991 | Korenberg | 122/149 |
| 5,050,512 | A | * | 9/1991 | Tratz et al. | 110/346 |
| 5,054,405 | A | * | 10/1991 | Walker | 110/254 |
| 5,158,025 | A | * | 10/1992 | Johnson | 110/235 |
| 5,516,499 | A | | 5/1996 | Pereira et al. | |
| 5,823,122 | A | * | 10/1998 | Chronowski et al. | 110/346 |
| 6,079,974 | A | * | 6/2000 | Thompson | 431/173 |

* cited by examiner

*Primary Examiner*—Denise L. Esquivel
*Assistant Examiner*—K. B. Rinehart
(74) *Attorney, Agent, or Firm*—Peter S. Gilster; Greensfelder, Hemker & Gale, P.C.

(57) ABSTRACT

Various smoke and combustible gas combustors (200, 300) are disclosed, and also disclosed are systems (100, 200) combining gas combustor with inventive burner. Such a burner (100 or 100') provides combustion of a particulate fuel such as sawdust, and many types of varying moisture content biomass fuels such as poultry litter. The combustors and burners exhibit a high turndown ratio ['TDR"].

The smoke or combustible gas combustors (200, 300) are combined synergistically with such a burner (100, 100'), or combined with another suitable burner, so as to provide high temperature burner output gases to the combustor, which has coaxial inner and outer combustion chambers (352, 356) inlet tuyere(s) connected to the inner combustion chamber for introducing combustible smoke or other gases to be burned into the inner combustion chamber at one end thereof with cyclonic flow, and in which combustion air is mixed with combustible smoke or other gases to form a gas stream moving through the inner combustion chamber with cyclonic movement. A preheat tube (331) within the combustible gas heating chamber receives heated exhaust gases from the burner, and communicates with the inner combustion chamber exit through a plurality of apertures (364) for controlled flow of said heated exhaust gases into the gas stream and so heating same by mixing the exhaust gases with the stream of air and combustible gases.

15 Claims, 3 Drawing Sheets

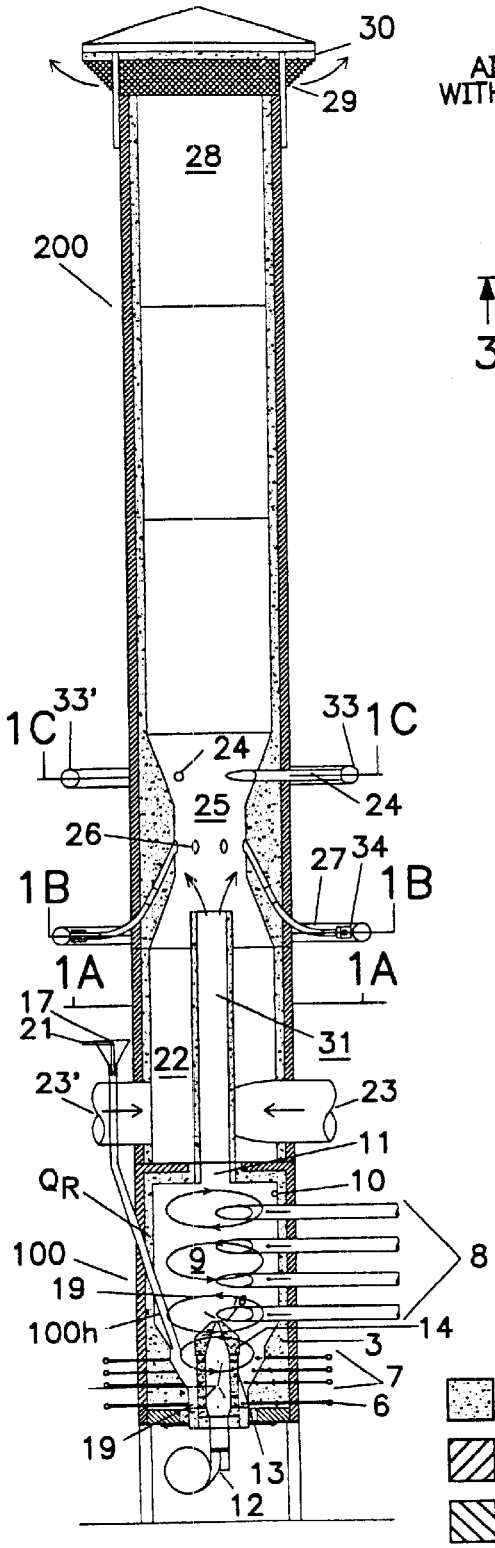
FIG. 1
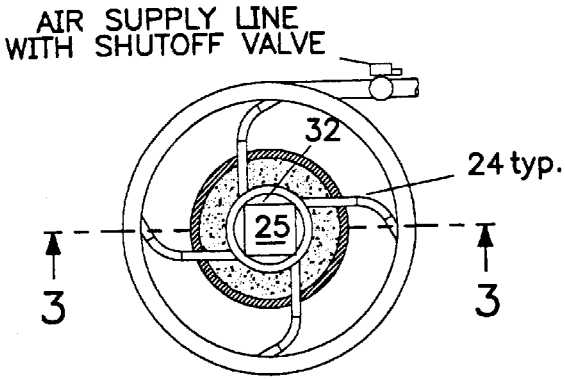
FIG. IC
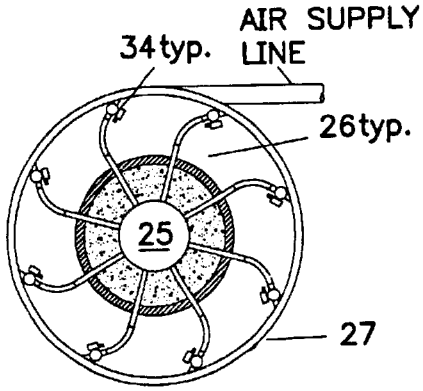
FIG. IB
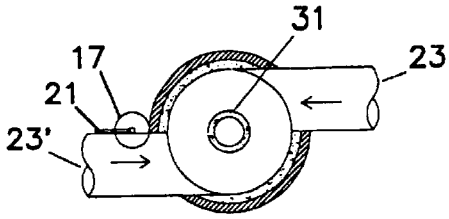
FIG. IA
REFRACTORY
INSULATION
INSULATING CASTABLE

COMBUSTORS AND BURNERS WITH HIGH TURNDOWN RATIO

CROSS REFERENCE TO RELATED APPLICATIONS(S)

The invention is related to improvements of U.S. Provisional Patent Application Ser. No. 60/149,273 filed Aug. 17, 1999, and U.S. patent application Ser. No. 09/363,470, filed Jul. 29, 1999, and claims priority of said application Ser. No. 09/363,470, copending and co-assigned, which is based upon and derives priority of U.S. Provisional Patent Application Ser. No. 60/095,054 filed Aug. 3, 1998, all of which are incorporated herein by reference, and all of which are application of the present inventors. Copending U.S. patent application Ser. No. 09/561,320 filed Apr. 28, 2000, of the present inventors, entitled Gas Combustor and Combustor System for Combustion of Smoke, Off Gases and Other Emissions, is also herein incorporated by reference. Which claim benefit to Provisional Application 60/151,840 filed Sep. 1, 1999.

BACKGROUND OF THE INVENTION

1. Field of the Invention

The invention is in the field of industrial burners, combustors and incinerators and, more particularly, relates to new industrial burners and/or combustors for combustion of either gaseous or particulate fuels including smoke.

Particulate fuels may be wet or dry sawdust and many types of varying moisture content biomass fuels including, agricultural products, wood waste, bagasse, poultry waste, and other cellulosic materials, and especially in the wood products manufacturing or processing operations. Gaseous fuels may mean (gases traditionally used as fuels or they may mean so-called off-gases, including smoke or other combustible gases produced by processes relating to such wood products and other gases, such as from kilns or primary burners, including industrial off-gases. Burners of the invention provide high efficiency. Specifically they may operate with high turndown ratios and high heat release ratios. As used herein, the term off-gases connotes gases produced not primarily as fuels but instead those produced by other processes and apparatus, including gases produced by burners whether of the present invention or other types.

2. Related Art

In the general field of burners, combustors and incinerators for industrial purposes there are myriad different configurations, wherein there has for many years been an increasing focus on efficiency and output. Thus, there have been proposals for swirling or cyclonic combustion and combustion chambers of unusual geometries, as well as many proposals for controlling the entry of air and fuel into the combustion chamber for contributing to swirling or other patterns of combustion motion. There have been various burners proposed for burning, as feed stocks, organics or biomass materials, including so-called green (high moisture content) sawdust, solid cellulosic or wood-containing waste, waste wood, and fragments of wood, and all of which may herein be referred to as wood products. And, burners of various configurations and capabilities have been proposed for combustion of off-gases.

In burners useful for burning such materials, there has been insufficient emphasis on achieving efficiency and flexibility which can result from achieving a high turndown ratio (which may for convenience be abbreviated "TDR"), which is the maximum firing rate of the burner divided by the minimum firing rate of the burner. Prior constructions have not achieved sufficiently high TDRs.

The provision of a high TDR burner, or a combustor and burner combination, capable of carrying out combustion of wood products is highly desirable, as such a burner would be capable of being operated over a great dynamic range. If, for example, in a manufacturing or materials handling operation which creates such wood products, which are to be combusted (as for heating or energy extraction for other processes or purposes), the use of a burner having a limited TDR can require that burner operation be terminated if wood product supply rates are insufficient to achieve the minimum firing rate of the burner. Or, if combustion of wood products at low feed rates is to be carried out, an auxiliary fuel such as natural gas, liquefied petroleum (LP) gas, propane, or fuel oil, may have to be fed into the burner for maintaining combustion. But, on the other hand, if the burner is designed for burning wood products at low feed rates, its output may be insufficient to handle high feed rates when wood products to be combusted are being produced at high volumes. Further, if TDR can be increased, much less auxiliary fuel will be required to initiate burner operation.

As an example, in a wood products manufacturing or processing operations, very substantial quantities of green sawdust are created during sawing, planing, shaping, etc., but the rate of production of sawdust will be dependent upon the various wood-handling processes, which vary in rate, time of operation, and volume, so that sawdust may be produced at a highly variable rate.

If the sawdust is to be combusted by a burner for the purpose of extracting heat for other uses (such as heating, boiler operation, drying, etc.), the use of a burner having a high TDR enables its operation on continuous basis or at least for longer periods of operation, as desired.

In the wood products industry, as including also the production of charcoal, there is a need also for dealing with smoke and other gases produced during operations. For example, in cooperage operations where barrels are produced for aging of beverages, such as wines or brandies, etc., some types of barrels require that they be charred, as for the aging of various kinds of whiskeys. Charring operations produce smoke which may need to be combusted. So also, in charcoal kilns, the off-gases are sources of environmental pollution, and may also need to be combusted, i.e., by oxygenation combustion.

It would be desirable to combine a burner, capable of burning wood products for the above-noted purposes, with features for combustion of off-gases in the wood products industry.

Present burners and combustors in the wood products industries have not met the needs for these kinds of combustion, and have not achieved satisfactory TDR and efficiencies for acceptable usage in the wood products industries.

As used for combustion of gases, constructions and methods of the presently claimed invention are of special utility and suitability for burning off-gases such as smoke in situations where other processes and apparatus have produced gases which are amenable to further combustion and which may be rendered less noxious or may be converted to a safer state or destroyed by being burned at relatively high temperatures.

For example, when wood products are charred as in making barrels, smoke may be released which advantageously can be burned.

As a further example, in making charcoal involving partial combustion of wood and other cellulosic or organic substances, including vegetable-based materials smoke may be released from charcoal kilns.

The present invention specifically includes improved gas combustors of high utility in wood products industries and charcoal production.

SUMMARY OF THE INVENTION

Accordingly, the present invention provides various combustors and burner-combustor embodiments for burning particulate fuel such as so-called green (high moisture content) sawdust, various feed stocks, organics or biomass materials, including solid cellulosic or wood-containing waste, waste wood, and fragments of wood, and all of which may herein be referred to as wood products or particulate organic fuels or materials.

The invention is also concerned with such burners and combustors which are capable of combustion of gases, such as off-gases produced in the wood products industry, or other gases which are to be oxygenated or burned for conversion to a condition environmentally non-polluting.

Burners and combustors of the present invention achieve high efficiency and flexibility, particularly achieving a very high TDR.

The inventive burners and burner-combustor combinations specifically achieve a high TDR while carrying out combustion of wood products. Burners and combustors of the invention are capable of being operated over a great dynamic range.

The new burners and combustors are especially useful in wood products manufacturing or processing operations, such as stave and barrel-forming (cooperage) operations which create very substantial quantities of green sawdust.

The new burners and combustors, because of their high TDR, efficiency and dynamic range, can be used in operation on continuous basis or for longer periods of operation, and at greatly variable output different as may be desired.

The new burners and combustors disclosed are capable of combustion of a high-moisture, low-Btu value fuels not only providing high TDR but also achieving a high heat release ratio, meaning heat output per volume per unit of time. This allows a smaller size burner or combustor of the present invention than otherwise would be required in a prior art burner, and so the invention results in a burner or combustor of lower cost than heretofore.

Another feature of the presently inventive burners and combustors is the capability for designing them to a desired scale, as according to the intended mode of usage and industry segment in which the burners and combustors will serve. Thus, they are easily scalable.

A further advantage of the inventive burners and combustors is their use of electronic controls using programmable logic controllers, for achieving precise, efficient, safe and reliable control and operation in all modes of usage.

Yet another feature of the invention is a gas combustor especially suited for combustion of smoke and various combustible gases, including off-gases in the wood products industry, such as for example gases produced during cooperage operations and gases produced during the operation of charcoal kilns, as well as other industrial off-gases.

The presently inventive burners and combustors achieve satisfactory TDR and efficiencies for acceptable usage in the wood products industries.

In addition, burners and combustors of the present invention are economical in construction and operation and are easily installed and operated.

The present invention specifically includes improved burner and combustor constructions and methods to provide gas combustors of high utility in wood products industries and charcoal production, as for burning smoke and other gases when wood products are charred as in making barrels, and in charcoal production.

Briefly, the present invention relates to various burner and combustor configurations. Each burner and combustors of the disclosure exhibits a high TDR for combustion of a principal fuel. Each of the proposed burners includes, or comprises, consists of, or consist essentially of, a housing defining an upright combustion chamber lined with refractory material and generally circular in horizontal section, a main combustion region within an upper extent the combustion chamber, an initial combustion zone at a lower end of the combustion chamber of reduced-size cross-section compared to the combustion chamber, a transition region within the combustion chamber increasing in cross-section from the initial combustion zone to the main combustion region, a ceiling of the combustion chamber, a principal fuel feed to supply particulate fuel with combustion air to the initial combustion region, and an auxiliary fuel feed to supply ignition fuel to the initial combustion region for igniting the principal fuel. Multiple sets of tuyeres are provided for controllably introducing combustion air tangentially regions of the combustion chamber for contributing to cyclonic combustion flow in such a manner as to increase diameter of combustion upwardly within the combustion chamber. A counterflow arrangement disrupts cyclonic flow near the ceiling. The ceiling defines an exit for providing escape from the combustion chamber of exhaust gases resulting from combustion in the combustion chamber. The arrangement is such that the principal fuel is ignited in the initial combustion region, and burns with cyclonic flow extending upwardly through the transition region with increasingly greater combustion diameter into the combustion chamber. Various ignition and control features are also disclosed.

Each of the new type of high TDR burners maybe combined synergistically with a smoke or combustible gas combustor mounted to or connected to the burner for receiving hot combustion exhaust gases of 1,600 degrees F. or greater, which exit into a preheat tube located within a smoke-combustor heating chamber. Smoke or other combustible gases such as off-gases from another process enter the heating chamber through gas tuyeres tangential to walls of the heating chamber. The smoke or gaseous combustibles are heated by the preheat tube. The combustor includes a venturi which creates a negative pressure in the heating chamber for drawing the combustible gases from the heating chamber and from the combustible gas tuyeres. Controlled high-velocity air is forced through the venturi tuyeres, causing the venturi action. Controlling the amount of high-velocity air forced into the venturi tuyeres and the cyclonic tuyeres regulates negative pressure created by the venturi. The high-velocity air also serves as combustion air for ignition of the combustible smoke or gases. More combustion air is forced into the top of the venturi chamber through cyclonic tuyeres, enhancing mixing of the air and combustible gases and causing the gases to burn in a cyclonic pattern in the combustion chamber of the combustor. The combustor can be operated to maintain proper negative pressure for optimum draft control while maintaining the correct amount of air and temperature for combustion of the combustible gases in the combustion chamber.

One configuration of smoke combustor disclosed includes a housing configured for receiving the heated exhaust gases from the burner, the housing defining a combustible gas heating chamber including coaxial inner and outer combustion chambers, one or more inlet tuyeres connected to the inner combustion chamber for introducing combustible smoke or other gases to be burned into the inner combustion chamber at one end thereof with cyclonic flow, means for mixing combustion air with said combustible smoke or other gases to form a combustion gas stream moving through the inner combustion chamber with cyclonic movement, a preheat tube within the combustible gas heating chamber into which the heated exhaust gases are ducted for preheating, the preheat tube being of substantial thermal mass and communicating with the inner combustion chamber exit through a plurality of apertures for controlled flow of said heated exhaust gases into the gas stream for preheating the combustible gas stream by mixing the exhaust gases with the stream of air and combustible gases for combustion thereof to provide combustion gases, means at an opposite end of the inner combustion chamber for redirecting counterflow movement of said combustion gases from the inner combustion chamber to the outer combustion chamber for counterflow of combustion gases therein relative to the inner combustion chamber, whereby combustion gases thence travel though the outer combustion chamber along a separating wall which separates the inner and outer combustion chambers, the outer combustion chamber including means for causing continued cyclonic movement of the combustion flow in the outer combustion chamber, and an outlet at an end of the outer combustion chamber remote from the redirection means for delivery of completely burned combustion gases.

Other objects and features will be in part apparent and in part pointed out below.

BRIEF DESCRIPTION OF THE DRAWINGS

FIG. 1 is a vertical cross-section of another embodiment of a burner including a gas or smoke-combustor in accordance with and embodying the present invention.

FIGS. 1A—through 1C—are horizontal cross sections taken along correspondingly numbered section lines of FIG. 1.

Corresponding reference characters indicate corresponding parts consistently throughout the several views of drawings.

DETAILED DESCRIPTION OF PRACTICAL EMBODIMENTS

Figure 2:
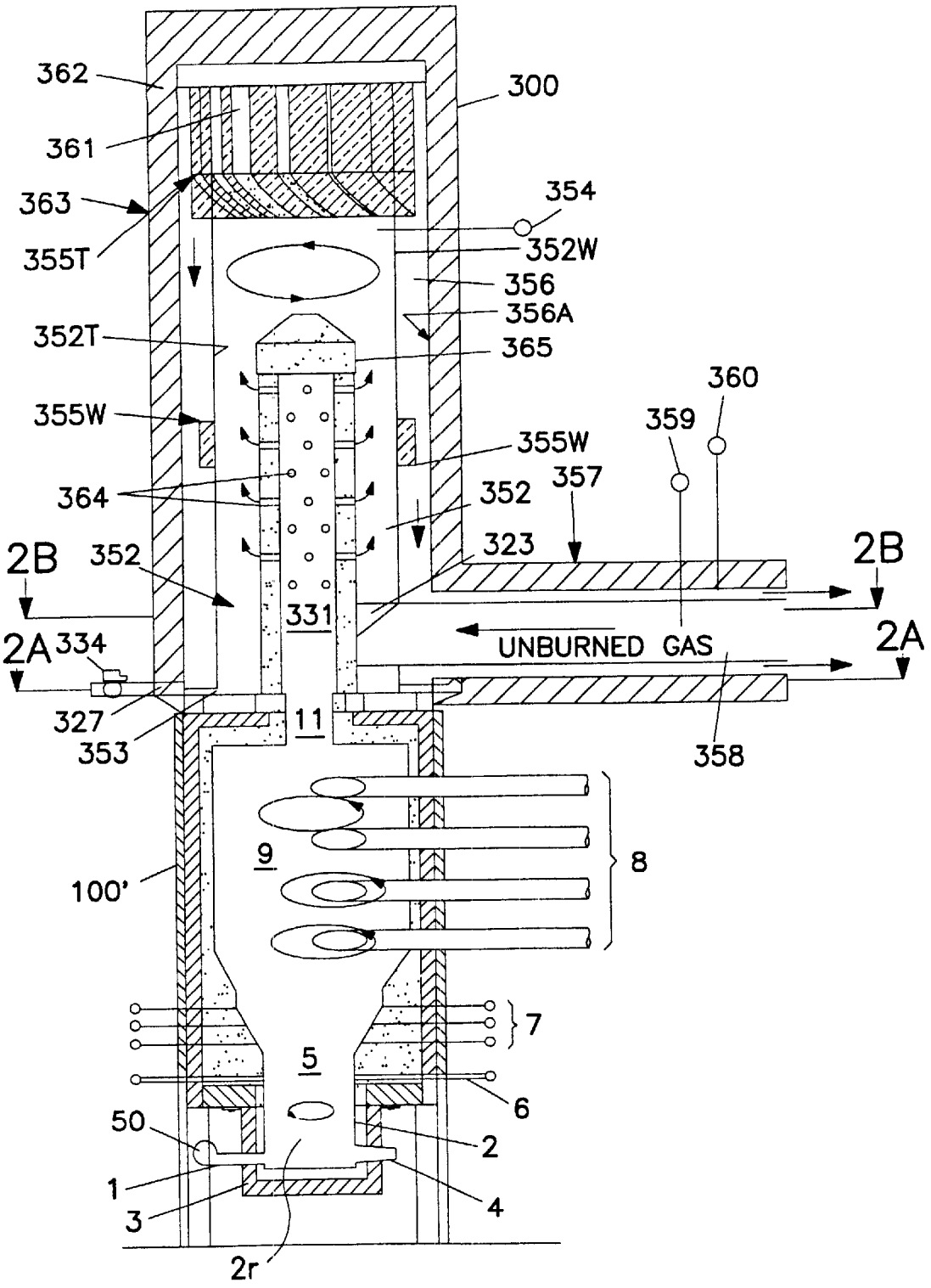
FIG. 2 is a vertical cross-section of another embodiment of a burner-combustor combination of the invention, wherein the gas or smoke-combustor of a further improved type different from the version of FIG. 1.
Figure 2A:
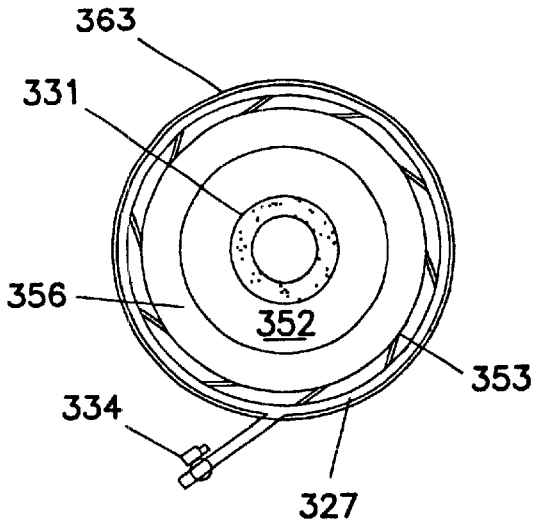
FIGS. 2A and 2B are horizontal cross sections taken along correspondingly numbered section lines of FIG. 2.
Figure 2B:
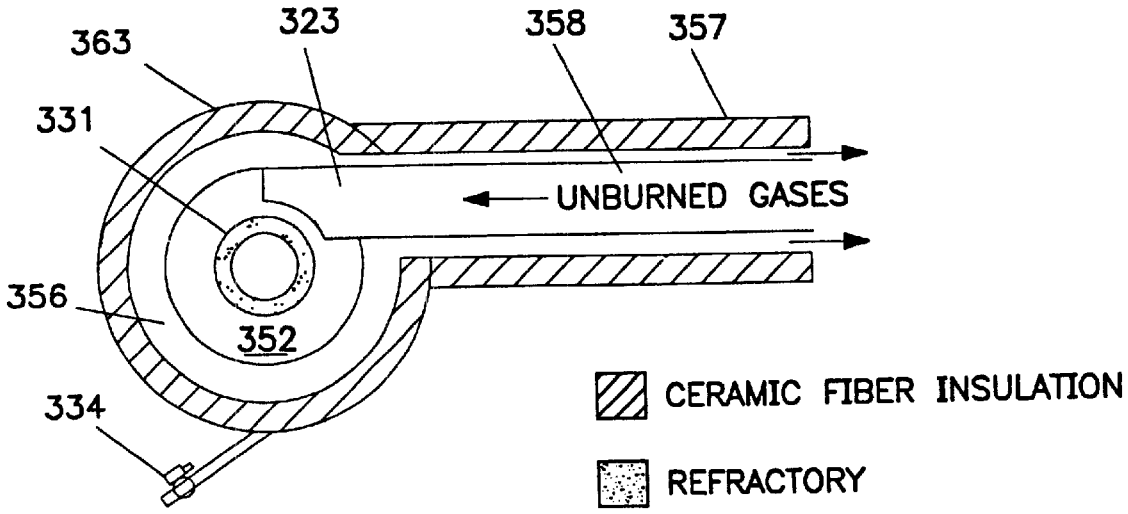

A burner 100 as shown in FIG. 1 is designed to burn many types of varying moisture content biomass fuels, and they may also be used to burn fuel gases, such as natural gas or liquefied petroleum gas or fuel oil. For descriptive purposes the words sawdust or wood will be used to connote such materials delivered to burner apparatus of the invention as fuel.

In FIG. 3, a smoke-combustor 200 is mounted to the top of a burner 100.

Although it is described in the above-referenced US application U.S. patent application Ser. No. 09/363,470, burner 100 will here be described in sufficient detail to understand its features.

Generally speaking, burner 100 has a housing defining an upright combustion chamber 9 lined with refractory material 9R and generally circular in cross section. Chamber 9 has a main combustion region within an upper extent the combustion chamber, an initial combustion zone at a lower end of the combustion chamber of reduced-size cross-section compared to the combustion chamber and a transition region increasing in cross-section from the initial combustion zone to the main combustion region. A principal fuel (e.g., sawdust) is supplied with combustion air to the initial combustion region. Tuyeres 8 controllably introduce combustion air tangentially into regions of the combustion chamber. Cyclonic combustion rises with increasing diameter upwardly within the combustion chamber. Cyclonic flow near a ceiling of the combustion chamber before output of hot exhaust gases is disrupted by counterflow tuyere(s) 10.

More specifically, a gas or oil fired burner 12 mounted to the bottom of burner 100. Gas or oil fired burner 12 introduces auxiliary fuel for ignition purposes. Burner 12 fires vertically up into a hollow interior of ignition tower 13 which is in the form of a hollow cylinder having a bullet-shaped upper head or end 16. Burner 12 introduces combustion heat into the combustion chamber in this manner, and for this purpose tower 13 includes through its side wall openings (tuyeres) 15 for ignition fuel and ignition air entry into transition section 5.

Hot ignition gases from auxiliary gas or oil burner 12 exit the hot tuyeres 14 and radiate out tangentially from the outer wall of ignition tower 13 into an annulus 19 and into funnel-shaped transition section 5. These annular or toroidal ignition gases initiate cyclonic combustion, and the combustion gases travel the same direction as the burning wood gases in burner 100. A small portion of the gas exits through a top opening 15 in a bullet-shaped stabilizing cone 16, which helps form and smooth the flow of flame and gases exiting funnel section 5.

Hot gases exiting the hot tuyeres are initially heat ignition tower 13, bullet-shaped stabilizing cone 16, and the surrounding refractory forming funnel section 5 and annulus 19. After these elements are heated to the point where combustion of the sawdust can begin, the hot exhaust gases exiting the hot tuyeres 14 stabilize the burning of the sawdust and at low fire rates are critical in maintaining combustion. The hot exhaust gases stabilize the burning of the sawdust by driving out moisture and raising its temperature to ignition temperature. These exhaust gases also help keep ignition tower 13 hot, which radiates heat into the incoming stream of sawdust causing ignition.

Fuel enters into burner 100 by means of a drop chute 17. The fuel drops directly into an area very close to the vertical center of funnel section 5. On positive pressure burners, an air curtain is formed by air from a tube 21 which equalizes pressure in the fuel feed tube and prevents gases and sawdust from being blown out of the burner. The downward momentum of the fuel carries the heavier particles such as sawdust and wood into annulus 19. Combustion air 20 is injected tangentially through tuyeres 6 in the outer walls of annulus 19. This air in combination with the hot oases exiting from hot tuyeres 14 causes the sawdust particles to spin with a high velocity inside annulus 19. The radiant heat created from the burning particles heats the walls of the annulus 19 to very high temperatures. The momentum of hot gases exiting the annulus 19 prevent excess sawdust from entering the annulus 19. This causes more burning in the funnel section 5 during high fire rates. As fuel burns in the annulus 19, the temperature drops allowing more fuel to enter the annulus 19, thereby maintaining an equilibrium temperature when firing at higher firing rates. The annulus 19 is a hot spot allowing only enough fuel into the annulus 19 for complete combustion and preventing a buildup of fuel. Proper airflow is utilized to keep the annulus 19 hot and free of fuel buildup.

The hot gases exiting hot tuyeres 14 also cause the sawdust particles to heat up faster and burn quicker. The small volume and large area of annulus 19 results in a large amount of heat release area with high radiant heat causing the particles to heat up fast and burn quickly. This ability to heat the particles quickly is critical to the success of burner 100 in burning high moisture content fuel because moisture is driven out fast. Wood pyrolysis begins followed by complete combustion. The quicker the wood starts to burn the more stable the fire is and the more responsive the burner is to changes in heat demand. This burner can go from a minimum-firing rate to full fire in a matter of minutes. Another advantage of fast heating and drying of the particles is a smaller burner size. As a result of all of the wet sawdust can be burned efficiently with an extremely high TDR. For example, a TDR of at least 35:1 can be achieved when burning green sawdust.

As wood particles in annulus 19 burn and become lighter, the cyclonic action causes the particles to rise out of the annulus into funnel section 5. Ignition tower 13 continues to provide heat for rapid heating and combustion of particles and gases in funnel section 5 of burner 100. More combustion air is injected tangentially into funnel section 5 through tuyeres 7. This air also adds to the cyclonic action and keeps the sawdust in motion. This air also prevents fuel particles from building up on the walls of funnel section 5. Funnel section 5 expands in area allowing for the expansion of gases coming from the burning fuel. Bullet-shaped stabilizing cone 16 helps to form and smooth the flow of flame and gases exiting funnel section 5. Other shaped structures can be fitted on top of ignition tower 13 creating other flame patterns. The hot gases exiting the top of bullet-shaped stabilizing cone 16 help ignite the gases in the center of the tornado of flame, which helps stabilize the burning gases as they swirl past the cone and meet at the apex of the cone. Controlled high-velocity combustion air is forced into tuyeres 7. The right amount of air is injected to both keep the particles moving cyclonically and to continue combustion of the sawdust. Funnel section 5 walls are angled up to keep the sawdust in the lower section to enhance combustion of the particles while at the same time preventing piling up of the material which would occur on a flat horizontal surface. More combustion air is injected tangentially to the combustion chamber 9 wall through tuyeres 8. Shear-tuyere air 10 is injected tangentially at a high velocity in an opposite direction to the direction of combustion airflow below. The shear-tuyere air also creates a shearing action and additional turbulence allowing for better air mixing with the gases and therefore better burning. The counter-flow also expands the flame out closer to the wall of the burner 100. The ignition tower 13, funnel and counter-flow air 10 results in a high heat release ratio. For example, 100,000 Btu/cu.ft./hr. has been achieved burning green sawdust. Choke 11 in conjunction with the cyclonic action minimizes the unburned particles of wood from exiting burner 100.

Smoke combustor 200 will now be described in detail in relation to burner 100.

Burner 100 produces hot exhaust gases of 1,600 degrees Fahrenheit or greater, which exit through choke 11 into smoke combustor 200. Combustor 200 includes a preheat tube 31 located in smoke-combustor heating chamber 22. Smoke or other combustible gases enter heating chamber 22 through one or more tuyeres 23 tangential to heating chamber 22 walls. The smoke or combustibles arc heated by preheat tube 31 in heating chamber 22. A venturi 25 is built into smoke-combustor 200, which creates a negative pressure in heating chamber 22 drawing the combustible gases from heating chamber 22 and combustible gas tuyeres 23. Controlled high-velocity air is forced through venturi tuyeres 26, causing the venturi action. Thus, the venturi tuyeres opening though the sidewalls of the venturi in upwardly inclined angular relation so as to emerge in the neck of the venturi, controllably and forcibly introducing high-velocity combustion air into the venturi at its narrowest section, accelerating flow venturi with venturi action. Controlling the amount of high-velocity air forced into venturi tuyeres 26 and cyclonic tuyeres 24 regulates negative pressure (i.e., partial pressure) created by venturi 25. If a larger negative pressure is desired, more air is forced into venturi tuyeres 26 and less air is forced into cyclonic tuyeres 24. If less negative pressure is desired more air is forced into cyclonic tuyeres 24 and less air is forced into venturi tuyeres 26. The high-velocity air is also the combustion air for ignition of the combustible gases. More combustion air is forced into the top of the venturi chamber 25 through four cyclonic tuyeres 24 in which the air exiting from these tuyeres intersects in a box pattern 32. This method of entering air into the upper venturi chamber enhances the mixing of the air and combustible gases and causes the gases to burn in a cyclonic pattern in combustion chamber 28. Shut-off valves 34 are located on each venturi tuyere 26. This allows air to be forced into one tuyere or in any combination up to all 6 tuyeres. The ability to force air through one venturi tuyere 26 or any combination gives the capability of creating a high draft with a low volume of air due to the high velocity of air in the venturi tuyeres 26. Because of these capabilities, smoke-combustor 200 can maintain proper negative pressure for optimum draft control while maintaining the correct amount of air and temperature for combustion of the combustible gases in combustion chamber 28. A manifold 27 supplies the controlled pressurized air to venturi tuyeres 26. A second manifold 33 supplies controlled pressurized air to cyclonic tuyeres 24. A thermocouple in the combustion chamber 28 monitors the temperature, which is used to control the firing rate of burner 100 and the amount of air coming through venturi tuyeres 26 and cyclonic tuyeres 24. A stainless steel screen 29 is placed over the exhaust opening of the chamber to prevent anything from entering combustion chamber 28 and to create more surface to radiate heat back into the exiting gas stream insuring that all the gas is completely burned. A refractory deflector 30 is also placed above the exhaust opening to radiate heat back into combustion chamber 28 to aid in maintaining temperature in combustion chamber 28 for proper combustion. This deflector 30 also prevents anything from entering combustion chamber 28.

The smoke-combustor can also be mounted at ground level and the exhaust gases from a burner can be ducted into the preheat tube in the smoke-combustor.

A typical burner control scheme is described and illustrated in above-referenced US application U.S. patent application Ser. No. 09/363,470, which includes a programmable logic controller (PLC) to automatically controls burner 100 and smoke-combustor 200. Said application Ser. No. 09/363,470 shows a typical control scheme of a burner and smoke-combustor system, wherein such PLC controls both burner 100 and smoke-combustor 200 for proper temperature and draft to completely combust the combustible gas or smoke produced by a combustible gas source.

Alternative arrangements can be utilized in which a gas or oil fired burner fires tangentially into an ignition can arrangement, as disclosed in above-referenced U.S. patent application Ser. No. 09/363,470, so that hot exhaust gases then enter the interior of ignition tower 13 from such ignition can.

Ignition tower 13 is constructed of a suitable heat and abrasion resistant refractory material such as those commercially available under the trademarks "CORAL PLASTIC" or "MIZZOU CASTABLE".

Refer to FIG. 2 which is a vertical cross-section of another embodiment of another burner of the invention, namely a smoke combustor 300 which forms an assembly with a burner 100'0 modified type has a high TDR for combustion of a principal fuel and which includes a gas or smoke-combustor 300 of a further improved type. It should be noted that the smoke combustor 300 can function quite satisfactorily with other styles of burners, e.g., natural gas burners, oil burners etc.

Thus, in a representative system, combustor 300 is mounted atop burner 100', which is including an ignition can 2, generally in accordance with above-referenced US application U.S. patent application Ser. No. 09/363,470.

Ignition-can 2 is a separate lower extension of the combustion chamber, being bolted onto burner 100' and can be removed for general maintenance. An ignition tower 13 is designed such that it may be bolted onto burner 100' at bolt points of ignition can 2. This modular arrangement allows for installation of ignition tower 13 without necessitating any modifications to the burner. The purpose of the ignition tower 13 is to create a higher TDR as explained in the following paragraphs.

Can 2, having an inside diameter of constant cross-section, is lined interiorly with refractory-material 3. Can 2 provides for ignition of introduced particulate fuel, e.g., sawdust, and transitions from its reduced diameter initial combustion region 2*r* into a funnel- or cone-shaped transition region 5 and thence upwardly into a main combustion chamber 9, similarly refractory line, such that the horizontal cross-section increases from the initial combustion region of can 2 upwardly within the burner to a constant diameter cross-section of combustion chamber 9 which forms a lower, central and upper sections each generally circular in horizontal section. A gas or oil fired burner 4 introduces an auxiliary fuel into can 2 to supply primary startup temperatures for sawdust ignition. Alternatively, sawdust can be tangentially blown pneumatically into can 2 with combustion air through a tube 1 to inner refractory 3 lined wall of ignition can 2. A small material handling fan 50 is close-coupled to a sawdust entry nozzle 1 in ignition can 2. This allows material handling fan 50 to sling the sawdust into ignition can 2. By this burner configuration and method, less air is needed to transport the sawdust, contributing to high TDR of the burner.

Therefore, the auxiliary fuel, whether it be gas or fuel oil or sawdust, is provided by burner 4 for ignition of the particulate fuel. The contribution of auxiliary fuel by burner 4 also stabilizes combustion temperatures in the ignition can 2 during normal firing operations. The sawdust as thus ignited and combustion takes place in an annulus or torus concentric about the vertical central axis of the burner and combustion chamber, occurring within the initial combustion region. As combustion occurs cyclonically, as with counterclockwise rotation about such axis, it produces a combustion cyclone, specifically a swirling tornado of flame, which is caused to pass up through combustion chamber 9. The cyclonic action causes the larger particles to wipe outer walls of can 2, stepped cone shaped funnel or transition section 5, and combustion chamber 9, which results in a longer retention time for these particles to achieve combustion. Primary combustion thus starts to occur in ignition can 2. The fuel particles rise in temperature, moisture is driven off, and small particles are pyrolized completely. Larger particles rise up in funnel section 5 and combustion chamber 9 and are pyrolized.

Burner 100' produces hot exhaust gases of typically 1600 deg. F. or greater, which exit through its choke 11. The incoming heated gases are used for preheating within combustor 300, and so may be referred to as hot preheat gases. They pass into a preheat tube 331 located in an inner burning chamber 352 of combustor 300. Preheat tube 331 is of relatively substantial thermal mass, being a hollow cast refractory material, herein called simply "castable." Tube 331 has a series of multiple tuyeres 364 opening through the cylinder walls and arranged circumferentially around and along the cylinder and oriented in such a way, that is, they are radially skewed, that they duct substantially tangentially to the outer wall allowing the burned gases from burner 100' to exit preheat tube 331 with a counter-clockwise cyclonic) flow. The top of preheat tube 331 is sealed off, i.e., closed, with a castable top 365 (e.g., of material similar to preheat tube 331) which is bullet-shaped and closes the upper end of preheat tube 331. It is important to observe that preheat tube 331 is thus closed upwardly except through tuyeres 364 for causing all of the hot gases from burner 100' to exit through tuyeres 364 into the inner combustion chamber 352. Thus, the hot gases enter the latter chamber to burn smoke or off gases.

Smoke or other combustible gases to be burned enter inner burning chamber 352 through a large diameter tuyere 323 at a lower end of inner burning chamber 352, which tuyere directs flow of the gases to be burned tangential to inner burner chamber wall 352 for counterclockwise cyclonic flow in the inner combustion chamber. The gases to be burned may be smoke or other combustible gases produced by processes relating to such wood products and other gases, such as from kilns or primary burners, including various kinds of industrial off-gases, any of which are characteristically combustible and may be degraded or converted from their present state to a safer state by more complete combustion.

Although a single large tuyere as that designated 323 is shown, there may be multiple tuyeres entering the inner combustion chamber, for example, from opposite sides of combustor 300, as in the embodiment shown in FIG. 3, and multiple such tuyeres may be in staggered or longitudinally stacked or arrayed relation, so that gases to be burned are introduced at or substantially near the lower end of the inner burning chamber. The vertical arrangement of preheat tuyeres 364 and the gas exit direction together ensure complete mixing of gases to be burned and reheat gases exiting, burner 100' and entering combustor 300 for combustion therein. This complete mixing causes the mixed gases to burn faster and more completely within combustor 300 than would otherwise occur. The inherent relatively high mass of (the refractory) cast preheat tube 33 also radiates heat into the incoming unburned gas stream for causing faster combustion and a more complete burn than otherwise could occur. Controlled high-pressure air is forced through tangential tuyeres 353. Note FIG. 2 A—A showing a single row often tuyeres evenly spaced in the base of the inner burning chamber 352. However, the number and size of tuyeres and number of rows of tuyeres will change depending on the size of the smoke combustor. This air, at 1 to 2 psig, as a representative pressure, is used as combustion air to burn the mixed gases and also for cooling to prevent inner combustion chamber 352 and outer combustion chamber 356 from becoming too hot. This method of forced entry of air into inner burner chamber at high velocity, preferably approximately 7000 fpm and higher, provides in this arrangement an essentially non turbulent laminar flow which results in a low Reynolds number, and enhances the mixing of the combustion air and oases causing the gases to burn in a cyclonic pattern in inner burning chamber 352. A manifold 327 supplies controlled pressurized combustion air to the tuyeres 353. A shutoff valve 334 is located on the inlet of manifold 327 if combustion air is not needed. If enough combustion air comes in with the smoke or off gases or enough excess air comes in with the external burner to complete combustion no other combustion air would be needed, so that valve 334 may be closed under these conditions.

A thermocouple 354 in inner combustion chamber 352 monitors the temperature and is used primarily to control the firing rate of burner 100' and combustor 300 and also the volumetric flow rate of air directed through tuyeres 353. Stainless steel deflectors 355*t* are radially skewed and spaced around the periphery at the top of inner combustion chamber 352 additionally force the burning gases to exit chamber 352 and to enter outer burning chamber 356 with continued cyclonic rotation in a counter-clockwise direction for movement down chamber 356. Wall deflectors 355*w* are angled at approximately 35 deg. to outer wall 352*w* of the inner burner chamber in one horizontal row located approximately half way vertically down the wall, so that deflectors 355*w* cause the burning gases to continue to turn counter-clockwise as they travel down outer combustion chamber 356. The counter-clockwise path, which is thus essentially helical or cyclonic, of movement of the burning gases in outer combustion chamber 356 increases their dwell time, i.e., the period of time required for them to transit outer combustion chamber 356, and so provides for much more complete combustion than otherwise would occur. Thus, there results a dwell time is approximately 0.81 seconds at maximum firing rate in the combustor 300 and approximately 0.94 seconds in a current example of the preheat duct.

After their cyclonic or helical path up the inner combustion chamber, redirection, and then down the length outer combustion chamber, the burned gases exit outer combustion chamber 356 through an outer duct 357, which coaxially surrounds delivery duct 358. Outer duct 357 not only provides an outlet for exhaust flow of gas combustion products but also services as a heat exchanger. That is, duct 357 transfers heat from the burned gases to the unburned gases in input duct 358 entering combustor 300, and so preheating the entering gases. This preheating causes unburned gases or partially burned gases to ignite immediately when they enter an oxygen rich environment within inner combustion chamber 352. The preheating of the smoke is an important and critical part of the design enabling smoke combustor 300 to use very little outside fuel for smoke combustion.

As an example of using the system, incoming unburned gases may range in temperature from 1100 deg. F. to 1800 deg. F. as opposed to 120 deg. F. to 160 deg. F. without the preheating duct. An ID fan (not shown) is used in a closed circuit duct to pull the gases into the smoke delivery duct 358, both inner and outer combustion chambers (respectively 352 and 356) and outer duct 357.

The burned gases in outer duct 357 can also be used to preheat combustion air for burner 100' by ducting the burned gases through a duct that transports combustion air to the burner creating an air heat exchange system. While such preheating is an advantage, being especially beneficial during very cold weather, it may be optional. A thermocouple 359 in the smoke delivery duct 358 monitors incoming unburned gas temperature. Another thermocouple 360 in outer duct 357 monitors the burned gas temperature of the gases leaving combustor 300. Thermocouple 360 is used to regulate firing rates of burner 100' and the amount of air going into tuyeres 364, also advantageously may be used to regulate the amount of air going into tuyeres 8 of burner 100' in the system shown, to ensure the proper temperature is maintained for complete burning of the gases. (Feedback is from the thermocouples in the inner burner chamber and the smoke-eater outlet i.e. 359 and 360. The control is through PID i.e. proportional, integral, and derivative loop. The temperature can be maintained readily to a tolerance of +/−10 deg F. Six inches of insulation 362 in the form of high temperature ceramic fiber completely surrounds the outer burning chamber of combustor 300. Six inches of high temperature ceramic fiber insulation also surrounds outer duct 357. An outer layer of stainless steel or other suitable material 363 of, for example, 16 gauge 304 stainless steel which has moderate high temperature resistance surrounds the several inches of insulation, thereby protecting the insulation. Inner and outer walls 352T, 352W of the inner burning chamber as well as inner wall 356A of the outer burning chamber can be made of high temperature stainless steel or other suitable metal or castable.

The temperature inside the smoke combustor 300 and at its can be maintained easily at 1200 deg F. up to 1900 deg F. or higher without any outside burner support after a time period ranging anywhere from 0.5 hr to 8 hr of burner 100' startup depending on moisture content of the wood or comparable fuel fed to burner 100'. The reason for such small dependence on outside burner support is due mainly to the fact that the smoke is preheated to such high temperatures (1100 deg. F. to 1700 deg. F. in the heat exchange duct before it entry into the combustion chamber of smoke combustor 300. It will be noted that if oxygen were introduced into the smoke carrying duct 358 the smoke would burn in the duct.

In general, dwell time as discussed above is a function of how much smoke is drawn into the kiln and the temperature it is heated to before it enters combustion chamber of smoke combustor 300 as well as the temperature of burned smoke maintained in smoke combustor 300. While the dwell times noted above are characteristic of a practical prototype, it is expected that in a construction of the invention using the inventive concepts of combustor 300 used with slower kiln charcoal production rates, the dwell time will increase.

Although combustor 300 is shown with burner 100', it should be emphasized that a combustor using the principles of combustor 300 can function with many other kinds of burners. Smoke combustor 300 is very efficient in that once it gets hot and starts burning smoke it needs little if any outside burner support to maintain combustion temperatures at 1525 deg F. or higher. One of the main reasons smoke combustor 300 is able to maintain these temperatures without outside burner help is the tremendous temperature rise in the smoke (or other gas being combusted) resulting from the heat exchange duct system

EXAMPLE

An experimental prototype of smoke combustor 300 as initially heated with combustion output from burner 100' has been tested numerous times. All tests resulted in very little heat being supplied, after startup, from burner 100'. As a matter of fact during the last test, the only outside heat needed was to warm up burner 100' and smoke combustor 300. A kiln was used with the experimental arrangement, and smoke from the kiln was made available to combustor 300 to be burned. Once the a kiln started producing smoke, the smoke combustor 300 maintained temperatures of 1600 deg F. or more by simply burning the smoke from the kiln. In the worst case, the burner 100' supplied heat in the range of 500,000 btu to 200,000 btu per hour for 8 hours before it was turned off and operation of combustor 300 continued. Temperatures as operation of combustor 300 continued were easily maintained between 1600 deg. F. and 1700 deg. F. and could have been still higher if permitted. During these tests, temperature could be maintained +/−10 deg F. of desired setpoint with the possible exception of the first two hours of the kiln startup during which time the temperature varied more. The temperatures of the smoke entering smoke combustor 300 ranged from 1100 deg. F. to 1800 deg. F. The total time to complete a kiln cycle ran from a high of 5 days for the first test to 3 days for the last two of several tests. This time was dependent on the amount of smoke being pulled from the kiln.

Rather than mounted atop burner 100' for direct entry of gases from burner 100' into burner 300 as shown, combustor 300 can instead be mounted at ground level in an arrangement by which exhaust gases from burner 100' are ducted into combustor 300. Thus, if appropriate in such an arrangement, a booster fan could be utilized to "push" unburned gases to smoke combustor 300 but is preferable to maintain smoke combustor 300 at negative pressure wherein smoke is drawn into it.

Burner 100' is illustrated as having the previously-described configuration especially useful for burning particulate fuels such as wood or wood products, and when so used with burner 100', combustor 300 is intended for receiving at least start-up heat from burner 100', which produces no smoke but only essentially completely combusted gases. But combustor 300 may be used with other burners configured for burning other organic fuels such as fuel oil or fuel oases, capable of providing sufficient thermal flow of high temperature exhaust gases into combustor 300, including possibly smoke, so that such off-gases or smoke from other sources will be entrained into the exhaust gases entering combustor 300 and therein burned at still higher temperatures. It will be seen, therefore, that smoke combustor 300 may receive its heating (or preheating) gases from various kinds of burners, and its smoke or off-gases from various kinds of sources, including charcoal kilns and other smoke-producing processes.

In substantially the same way as for combustor 200, a control system is also provided for combustor 300 in accordance with the disclosure of FIG. 6. The control system provides the important function of controlling gas and air flows in response to said temperature to maintain proper partial pressures within combustor 300 for optimum draft control while maintaining the correct amount of air and temperature for combustion of the combustible gases in the gas combustion chamber.

Therefore, it is seen that combustor 300 comprises or consists essentially of a combustor housing mounted to or connected to burner 100' (or any other burner producing suitable exhaust heat) as a combustion source of hot preheat gases so that the combustor is situated for receiving the hot preheat exhaust gases from the combustion chamber exit of burner 100' or other burner, and such gases may for convenience here be called either combustion source gases or hot preheat gases, for they are used for preheating purposes. The housing defines a combustible gas heating chamber having coaxial inner and outer combustion chambers (respectively 352 and 356), having an inlet duct 358 and an outlet or discharge duct 357 coaxial with inlet duct 358 for outward flow of burned gases from the outer combustion chamber (and for the purpose of preheating smoke or off gases before they enter the combustor 300.) Inlet duct 358 communicates with one or more inlet tuyeres 323 so that preheated combustible gases to be burned within the combustor are introduced into the inner combustion chamber at one end thereof with cyclonic flow. Preheat tube 31 located within inner combustion chamber 352 provides communication with the combustion chamber exit 11 (or exit chamber or nozzle of any other style or type of burner) from which hot gases are emitted, and so preheat tube 31 receives the preheat gases and thus introduces them through multiple tuyeres 364 opening through side walls of the preheat tube into inner combustion chamber 352, these tuyeres 364 being arranged circumferentially around the cylinder and along its so they duct substantially tangential to the outer wall for allowing burned gases from burner 100' or other burner to emerge from preheat tube 331 with cyclonic flow.

Inlet tuyere 323 (or multiple such tuyeres) similarly introduce combustible gases into inner combustion chamber 352 combustible gas heating chamber cyclonically, by injection tangentially to outer walls of inner combustion chamber 352 with the same direction of rotation about the vertical longitudinal axis of the heating chamber, such that the combustible gases in the inner combustion chamber 352 will be heated by the preheat tube 331 and their combustion there initiated. Also, combustion air tuyeres 353 open into the inner combustion chamber 352 though the side walls of the end of the heating chamber, and are so oriented for controllably and forcibly introducing high-velocity combustion air into the inner combustion chamber 352 for mixing of the air and combustible gases to burn with cyclonic pattern in the combustor. A redirector, in the form of slotted vents 361 at the closed upper, opposite end of the apparatus and which vents open from inner combustion chamber 352 to outer combustion chamber 356, serves as means for redirecting counterflow movement of combustion gases from inner combustion chamber 352 to outer combustion chamber 356 for say counterflow relative to the inner combustion chamber, so rotation of the gases continues flowing counterclockwise but vertically downward. The combustion gases accordingly travel though outer combustion chamber 356 along the separating wall **352*w* which separates the inner and outer combustion chambers. Vanes 355*w* are located in outer combustion chamber 356 for causing movement of the combustion flow in the outer combustion chamber 356 to be cyclonic. An outlet tube (duct 357) communicates with the outer combustion chamber 356** at an end thereof remote from the redirection means, for delivery of completely combusted gases.

Outlet duct 357 extends away from outer heating chamber 356, and because this duct is coaxially outside inlet duct 358 which thus transports preheated combustible gases to be burned within combustor 300, heat is transferred from outlet duct 357 from the burned gases for initial preheating of the combustible gases to be burned.

Temperature measuring apparatus measures temperature in the gas combustion chamber.

As according to above-referenced US application U.S. patent application Ser. No. 09/363,470, a control system controls gas and air flows (and burner 100' or other burner firing rates) in response to said temperature to maintain proper partial pressure within the smoke combustor for optimum draft control while maintaining the correct amount of air and temperature for combustion of the combustible gases in the inner and outer combustion chambers.

Therefore, it is seen that outlet duct 357 extends away from heating chamber in coaxial relationship with inlet duct 358 receiving the combustible gases to be burned within the combustor, whereby heat is transferred by the outlet tube from the burned gases for initial preheating of the combustible gases to be burned.

Reference characters 358, 359 and 360 constitute first, second and third temperature measuring means for measuring temperature, respectively, in the inner combustion chamber, the inlet duct and the outlet duct. It will then be evident that the control system as according to above-referenced US application U.S. patent application Ser. No. 09/363,470, controls gas and air flows with said combustor in response to said temperature measuring means. As therein described, the control system maintains proper partial pressure within said combustor for optimum draft control while maintaining the correct amount of air and temperature for combustion of the combustible gases in the inner and outer combustion chambers.

When combined with burner 100' (or any other burner, such as burner 100), smoke combustor 300 will be appreciated to provide a system advantageously formed by the combination of a principal fuel burner having a high turndown ratio for combustion of at least a particulate primary fuel, such as wood sawdust, but may also or alternatively burn a secondary fuel such as natural or liquefied petroleum gas, or fuel oil, in which the fuel of whatever type is burned with combustion air to provide heated exhaust gases having thermal content and volume useful for preheating a further combustion process, and the smoke combustor carries out that combustion process, in that it defines a housing configured for receiving the preheated burner gases for complete combustion. The housing defines a combustible gas burning chamber having an inlet and an outlet, the burning chamber including, as herein described, coaxial inner and outer combustion chambers. One or more inlet tuyeres are connected to the inner combustion chamber for introducing combustible smoke or other gases (which will have been substantially preheated by the duct carrying the burnt gases away from the combustion chamber 300) to be burned into the inner combustion chamber at one end thereof with cyclonic flow. The combustor defines means for mixing combustion air with said combustible smoke or other gases to form a gas stream moving through the inner combustion chamber with cyclonic movement. A preheat tube is located within the combustible gas heating chamber into which the heated exhaust gases are ducted for preheating so as to cause heating of smoke to combustion temperatures . The preheat tube is of substantial thermal mass and communicates with the inner combustion chamber exit through a plurality of apertures for controlled flow of said heated exhaust gases into the gas stream for heating the gas stream by mixing the exhaust gases with the stream of air and combustible gases for combustion thereof to provide combustion gases. The combustor also defines means at an opposite end of the inner combustion chamber for redirecting counterflow movement (counterclockwise flow) of said combustion gases from the inner combustion chamber to the outer combustion chamber for counterflow (counterclockwise flow) of combustion gases therein, whereby combustion gases thence travel though the outer combustion chamber, and along a separating wall which separates the inner and outer combustion chambers. The outer combustion chamber includes means for causing continued cyclonic movement of the combustion flow in the outer combustion chamber, and an outlet at an end of the outer combustion chamber remote from the redirection means for delivery of completely burned combustion gases.

While in the arrangement shown, the direction of movement of combustion gases in the inner and outer combustion chambers are respective upward and downward, and the gases enter the inner combustion chamber and exit the outer combustion chamber at the respective lower ends of these chambers, the combustor may alternatively be configured with an obverse relationship, in which gases to be burned enter an upper end of an inner combustion chamber, flow downwardly therein, thence upwardly through an outer combustion chamber, and exit from the outer combustion chamber at or proximate an upper end thereof, generally as according to copending U.S. patent application Ser. No. 09/561,320 filed Apr. 28, 2000, entitled Gas Combustor and Combustor System for Combustion of Smoke, Off Gases and Other Emissions, herein incorporated by reference.

Those skilled in the art will perceive that the combination of a high-output, high TDR burner such as burner 100 or burner 100' with smoke combustor 200 or 300, having a capability for burning smoke produced by various wood combustion processes, including charcoal production and waste wood combustion, as well as other smoky combustion of organic materials, offers a special synergism of features and advantages will be especially noteworthy in the wood products industries or any other industry that produces smoke or off gases suitable for burning, but it will be emphasized again that combustor 300 can be fired with a suitable burner.

In view of the foregoing description of the present invention and practical embodiments it will be seen that the several objects of the invention are achieved and many other advantages are attained.

The embodiments and examples were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

The breadth and scope of the present invention should not be limited by any of the above-described exemplary embodiments, but should be defined only in accordance with the claims appended hereto and their equivalents.

What is claimed is:

1. A combustible gas combustor for burning smoke and other combustible gases, comprising a combustor housing configured for receiving heating gases from a heat source, the housing defining a refractory-lined or high temperature stainless steel combustible gas heating chamber, a preheat tube located within the combustible gas heating chamber and communicating with a combustion chamber exit for receiving hot combustion source gases, combustible gas tuyeres for introducing combustible gases into the combustible gas heating chamber tangentially to inner walls of the combustible gas heating chamber, such that the combustible gases therein will be heated by the preheat tube, a venturi communicating with the combustible gas heating chamber for creating a partial pressure in the combustible gas heating chamber for drawing gases thereinto, venturi combustion air tuyeres opening though the side walls of the venturi for controllably and forcibly introducing high-velocity combustion air into the venturi and for accelerating flow through the venturi with venturi action, a gas combustion chamber into which the venturi opens in which combustion of the combustible gases occurs, temperature measuring apparatus for measuring temperature in the gas combustion chamber, and a control system for controlling gas and air flows in response to the temperature for controlling combustion of the combustible gases in the gas combustion chamber.

2. In combination, a principal fuel burner having a high turndown ratio for combustion of at least a carbon-based fuel such as wood sawdust, natural gas, fuel oil or other fuel, the burner comprising means for burning the fuel with combustion air and providing heated exhaust gases having thermal content and volume useful for preheating a further combustion process, and a smoke combustor including a housing configured for receiving the heated exhaust gases, the housing defining a combustible gas heating chamber including coaxial inner and outer combustion chambers, one or more inlet tuyeres connected to the inner combustion chamber for introducing combustible smoke or other gases to be burned into the inner combustion chamber at one end thereof with cyclonic flow, means for mixing combustion air with the combustible smoke or other gases to form a combusted gas stream moving through the inner combustion chamber with cyclonic movement, a preheat tube within the combustible gas heating chamber into which the heated exhaust gases are ducted for preheating, the preheat tube being of substantial thermal mass and communicating with the inner combustion chamber exit through a plurality of apertures for controlled flow of the heated exhaust gases into the gas stream for heating the combustible gas stream by mixing the exhaust gases with the stream of air and combustible gases for combustion thereof to provide combustion gases, means at an opposite end of the inner combustion chamber for redirecting counterflow movement of the combustion gases from the inner combustion chamber to the outer combustion chamber for counterflow of combustion gases, whereby combustion gases thence travel though the outer combustion chamber along a separating wall which separates the inner and outer combustion chambers, the outer combustion chamber including means for causing continued cyclonic movement of the combustion flow in the outer combustion chamber, and an outlet at an end of the outer combustion chamber remote from the redirection means for delivery of completely burned combustion gases.

3. In combination, a source of heated gases useful for preheating a further combustion process, and a smoke combustor including a housing configured for receiving the heated exhaust gases, the housing defining a combustible gas heating chamber including coaxial inner and outer combustion chambers, one or more inlet tuyeres connected to the inner combustion chamber for introducing combustible smoke or other gases to be burned into the inner combustion chamber at one end thereof with cyclonic flow, means for mixing combustion air with the combustible smoke or other gases to form a gas stream moving through the inner combustion chamber with cyclonic movement, a preheat tube within the combustible gas heating chamber into which the heated exhaust gases are ducted for preheating, the preheat tube being of substantial thermal mass and communicating with the inner combustion chamber exit through a plurality of apertures for controlled flow of the heated exhaust gases into the gas stream heating the combustible gas stream by mixing the exhaust gases with the stream of air and combusted gases for combustion thereof to provide combustion gases, means at an opposite end of the inner combustion chamber for redirecting the cyclonic flow movement of the combustion gases from the inner combustion chamber to the outer combustion chamber for in the same direction of cyclonic flow of combustion, whereby combustion gases thence travel though the outer combustion chamber along a separating wall which separates the inner and outer combustion chambers, the outer combustion chamber including means for causing continued cyclonic movement of the combustion flow in the outer combustion chamber, and an outlet at an end of the outer combustion chamber remote from the redirection means for delivery of completely burned combustion gases.

4. For use with a burner providing hot combustion exhaust gases, comprising a smoke or other combustible gas combustor, the combustor comprising:

a combustor housing mounted to or connected to the burner for receiving said hot combustion exhaust gases from the burner, a refractory-lined combustible gas heating chamber, a preheat tube located within the combustible gas heating chamber, the preheat tube communicating with the combustion chamber exit for flow within the preheat tube of the hot combustion exhaust gases, combustible gas tuyeres for introducing combustible gases into the combustible gas heating chamber tangentially to inner walls of the combustible gas heating chamber, such that the combustible gases therein will be heated by the preheat tube, a venturi communicating with the combustible gas heating chamber for creating a partial pressure in the combustible gas heating chamber for drawing the combustible gases from the heating chamber and from the combustible gas tuyeres, venturi combustion air tuyeres opening though the side walls of the venturi and so oriented within a neck of the venturi for controllably and forcibly introducing high-velocity combustion air into the venturi and for accelerating flow through the venturi with venturi action, venturi cyclonic air tuyeres opening through an upper end of the venturi for enhancing mixing of the air and combustible gases and causing the gases to burn in a cyclonic pattern in the combustor, a gas combustion chamber into which the venturi opens in which combustion of the combustible gases occurs, temperature measuring apparatus for measuring temperature in the gas combustion chamber, and a control system for controlling gas and air flows in response to said temperature to maintain proper partial pressure within the venturi for optimum draft control while maintaining the correct amount of air and temperature for combustion of the combustible gases in the gas combustion chamber.

5. A combustor as set forth in claim 4, wherein the burner has as a particulate fuel as a principal fuel.

6. A burner as set forth in claim 5, wherein the particulate fuel is sawdust.

7. A combustor as set forth in claim 4 wherein the control system comprises temperature sensors for the burner and combustor, a PLC means operating to increase or decrease the amount of heat supplied by the burner to the combustor and to control the rate of combustion in the combustor in response to said temperatures sensors according to parameters programmed into the PLC means, said parameters including temperatures or temperature ranges that should be maintained during any time of operation of the burner, controllable devices for controlling the amount of air flowing into the burner and combustor through the tuyeres, the controllable devices being responsive to the PLC means in a sense for regulating airflow to maintain proper temperatures in the burner and combustor to regulate the amount of combustion heat produced therein.

8. A smoke or other combustible gas combustor comprising:

a combustor housing configured for receiving heating gases from a heat source, the housing defining a refractory-lined combustible gas heating chamber, a refractory preheat tube located within the combustible gas heating chamber, the preheat tube communicating with the combustion chamber exit for flow within the preheat tube of the hot combustion source gases, combustible gas tuyeres for introducing combustible gases into the combustible gas heating chamber tangentially to walls of the combustible gas heating chamber, such that the combustible gases therein will be heated by the preheat tube, a venturi communicating with the combustible gas heating chamber for creating a partial pressure in the combustible gas heating chamber for drawing the combustible gases from the heating chamber and from the combustible gas tuyeres, venturi combustion air tuyeres opening though the side walls of the venturi and so oriented within a neck of the venturi for controllably and forcibly introducing high-velocity combustion air into the venturi and for accelerating flow through the venturi with venturi action, venturi cyclonic air tuyeres opening through an upper end of the venturi for enhancing mixing of the air and combustible gases and causing the gases to burn in a cyclonic pattern in the combustor, a gas combustion chamber into which the venturi opens in which combustion of the combustible gases occurs, temperature measuring apparatus for measuring temperature in the gas combustion chamber, and a control system for controlling gas and air flows in response to said temperature to maintain proper partial pressure within the venturi for optimum draft control while maintaining the correct amount of air and temperature for combustion of the combustible gases in the gas combustion chamber.

9. A smoke or other combustible gas combustor comprising:

a combustor housing configured for receiving heated gases from a heat source, the housing defining a combustible gas heating chamber having an inlet and an outlet, the heating chamber including coaxial inner and outer combustion chambers, the outlet providing for outward flow of burned gases from the outer combustion chamber, one or more inlet tuyeres connected to the inlet for introducing combustible gases to be burned into the inner combustion chamber at one end thereof with cyclonic flow, a preheat tube within the combustible gas heating chamber and communicating with the combustion chamber exit for receiving flow of hot combustion source gases from a combustion source, the inner combustion chamber surrounding the preheat tube, multiple tuyeres opening through side walls of the preheat tube into the inner combustion chamber, one or more tuyeres for introducing combustible gases into the combustible gas heating chamber tangentially to inner walls of the combustible gas heating chamber, such that the combustible gases therein will be heated by the preheat tube and their combustion initiated, combustion air tuyeres opening though the side walls of the inner combustion chamber and so oriented for controllably and forcibly introducing high-velocity combustion air into the inner combustion chamber for mixing of the air and combustible gases to burn in a cyclonic pattern in the combustor, the tuyeres opening through side walls of the preheat tube are arranged circumferentially around the periphery and along at least a substantial portion of the length of the preheat tube with such orientation that the tuyeres duct substantially tangential to the outer wall for allowing the hot preheat gases to exit the preheat tube with cyclonic flow, means at an opposite end of the inner combustion chamber for redirecting counterflow movement of combustion gases from the inner combustion chamber to the outer combustion chamber for continued cyclonic rotation in the same direction of rotation of combustion gases relative to the inner combustion chamber, whereby combustion gases thence travel though the outer combustion chamber along a separating wall which separates the inner and outer combustion chambers, the outer combustion chamber including vanes for causing the continued cyclonic movement of the combustion flow in the outer combustion chamber, the outlet being provided by a duct communicating with the outer combustion chamber at an end thereof remote from the redirection means, for delivery of completely combusted exhaust gases.

10. A combustor as set forth in claim 9, wherein the tuyeres opening through side walls of the preheat tube are arranged circumferentially around the periphery and along at least a substantial portion of the length of the preheat tube with such orientation that the tuyeres duct substantially tangential to the outer wall for allowing the hot preheat gases to exit the preheat tube with cyclonic flow.

11. A combustor as set forth in claim 9, further comprising first, second and third temperature measuring means for measuring temperature, respectively, in the inner combustion chamber, the inlet duct and the outlet duct.

12. A combustor as set forth in claim 9 further comprising a control system for controlling gas and air flows with the combustor in response to the temperature measuring means.

13. A combustor as set forth in claim 12, wherein the control system maintains proper partial pressure within the combustor for optimum draft control while maintaining the correct amount of air and temperature for combustion of the combustible gases in the inner and outer combustion chambers.

14. A combustor as set forth in claim 9, wherein the outlet duct extends away from heating chamber in coaxial relationship with an inlet duct receiving the combustible gases to be burned within the combustor, whereby heat is transferred by the outlet tube from the burned gases for initial preheating of the combustible gases to be burned, and further comprising first, second and third temperature measuring means for measuring temperature, respectively, in the inner combustion chamber, the inlet duct and the outlet duct, and a control system for controlling gas and air flows with the combustor in response to the temperature measuring means, wherein the control system maintains proper partial pressure within the combustor for optimum draft control while maintaining the correct amount of air and temperature for combustion of the combustible gases in the inner and outer combustion chambers.

15. A combustor as set forth in claim 9, wherein the outlet duct extends away from heating chamber in coaxial relationship with an inlet duct receiving the combustible gases to be burned within the combustor, whereby heat is transferred by the outlet tube from the burned gases for initial preheating of the combustible gases to be burned.

* * * * *